United States Patent [19]

Janke

[11] 4,333,295

[45] Jun. 8, 1982

[54] CASEMENT FRAME

[75] Inventor: Bernhard Janke, Bindlach, Fed. Rep. of Germany

[73] Assignee: HEF-Fenstertechnik Vetriebs GmbH, Fed. Rep. of Germany

[21] Appl. No.: 152,302

[22] Filed: May 22, 1980

[51] Int. Cl.[3] ..... E06B 3/26

[52] U.S. Cl. ..... 52/730; 49/DIG. 1; 52/398; 52/402; 52/461

[58] Field of Search ..... 52/730, 393, 398, 402, 52/403, 731, 461, 464; 49/DIG. 1

[56] References Cited

FOREIGN PATENT DOCUMENTS 2115154 10/1972 Fed. Rep. of Germany ... 49/DIG. 1

2715010 10/1978 Fed. Rep. of Germany ... 49/DIG. 1

2814649 10/1979 Fed. Rep. of Germany ..... 52/730

2828504 1/1980 Fed. Rep. of Germany ..... 52/730

2013267 8/1979 United Kingdom ..... 52/730

*Primary Examiner*—J. Karl Bell

[57] ABSTRACT

An interconnecting spacer is interposed between a pair of channel members, each having a central portion and substantially normally extending flanges. The spacer is H-shaped in cross section, having a central cross-bar and a pair of lateral side walls. The ends of the side walls and flanges of the channel members have cooperative engagement means. A plug is inserted within the cavities formed by the spacer and the channel members having a dimension such that the engagement means are placed under stress to lock the same.

12 Claims, 3 Drawing Figures

CASEMENT FRAME

BACKGROUND OF THE INVENTION

The present invention relates to the formation of casement frames, and in particular to means for joining channel members into a casement frame.

A casement frame is known from German publication DE-PS No. 2,130,496, in which an assembly of two channel-shaped section members are connected by means of a continuous plastic strip. The plastic strip is designed as a solid rod, hence is expensive as to its material. The solid rod is applied with laterally flexing arms, which snap behind the projection formed on the section channels when they are fitted together. Thus, the construction requires great dimensional precision. Great difficulty is encountered in maintaining the toluenes, particularly with respect to the plastic section. Rubbery, elastic spring bodies, effective only in the direction normal to the plane of the window or panel contained in the casement, have been used to clamp the plastic strip to the interior of the channel section, and thus, the tolerance problem is partially solved. The problem is not entirely solved with respect to the design of the laterally flexing arms of the plastic strip.

Another design is shown in German publications DOS No. 1,914,843, and DAS No. 1,955,591, wherein the plastic strip is formed as an H-shaped section. The freely extending lateral webs thereof are resiliently compressable and engage into corresponding grooves or depressions formed in the channel section members.

Such connection, however, is not strong enough, especially in the direction parallel to the plane of the window or panel, and additional measures for locking the sectional parts together are required.

It is an object of the present invention to provide a casement frame assembly, which avoids the foregoing objections, and which is simple and inexpensive to form.

It is a further object of the present invention to provide a casement frame assembly, wherein a plastic spacer strip is anchored in such a way to the section channel members, that a secure locking of the spacer strip is insured, without any overy high requirement for accuracy of size and dimensional configuration. It is still another object of the present invention to provide a casement frame assembly, which has improved sound absorption as well as increased heat-insulation.

SUMMARY OF THE INVENTION

According to the present invention, a frame assembly, for casements, door panels and the the like is provided comprising a pair of channel members, each having a central portion and substantially normally extending flanges. A spacer is interposed between the channel members, being H-shaped in cross section, having a central cross-bar and a pair of lateral side walls, the ends of the side walls and the flanges having cooperative engagement means. A plug is inserted within the cavities formed by the spacer and the channel members having a dimension such that the engagement means are placed under stress to lock the same.

The plug is formed with a surface conforming to the central portion of the channel member, having lateral wing-like extensions which fit between the ends of the lateral side walls and the channel member, so as to be placed under compression. The plug is dimensioned so as to be placed under compression, having a vector perpendicular to the cross-bar, as well as perpendicular to the lateral side walls.

The spacer is made of rigid plastic material, while the insert plug is formed of more resilient plastic material.

Full details of the present invention are set forth in the following disclosure and in the accompanying drawings.

BRIEF DESCRIPTION OF THE DRAWINGS

In the accompanying drawings.

DESCRIPTION OF THE INVENTION

Figure 1:
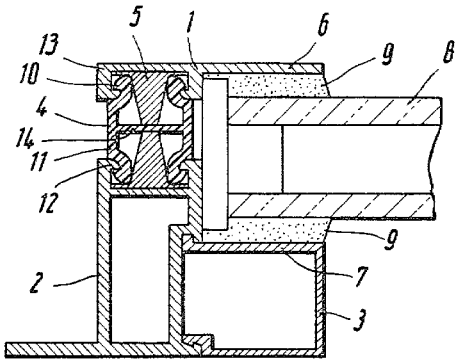
FIG. 1 is a horizontal, transverse, sectional view through a casement frame, for a window.

The casement frame formed in accordance with the present invention as illustrated in cross section in FIG. 1, comprises an outer section formed of an elongated channel member 1, and inner section formed of a rectangular channel member 2, which is welded, glued, or otherwise integrally connected to a U-shaped channel support member 3. The inner and outer sections 1 and 2 are each formed with a central portion, and a pair of substantially normal flanges along each edge.

The inner and outer sections 1 and 2 are joined together by a relatively rigid plastic spacer strip 4, and a pair of resilient plastic wedge inserts 5. The outer section 1 is formed with a flat extension 6, between which, and on one side 7 of the U-shaped support member 3, is lodged a panel 8, such as a window pane. Putty 9 is used to embed and securely hold the panel member 8 in sealed position.

Preferably, the section members 1, 2, and 3 are formed of aluminum, although other metals and alloys may be used. The relatively rigid plastic spacer strip 4 is preferably formed of alkylbenzene sulfonate (ABS) while the softer plastic inserts 5 may be of natural rubber, neoprene or other synthetic rubbers.

As seen in FIG. 4, the strip is formed in cross section and the general shape of an H, having a pair of vertical or lateral side walls 11, provided at their upper and lower ends with outwardly open hook-like flanges 10, and a connecting cross-bar 14. Both the inner channel section 2 and the outer channel section are formed with opposing skirts 12, 13, which have inwardly directed hooks corresponding in shape to those found on the spacer strip 4.

Figure 2:
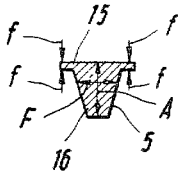
FIG. 2 is a transverse section through an elastic insert employed in the assembly of FIG. 1.

The wedge insert 5, as seen in FIG. 2, is formed of an elongated strip member having a keystone shaped body 16, and a pair of projecting flat shoulders 15, along each of the upper edges, elongating the top surface of the body 16, in transverse section, to conform to the central portion of the channel member. The depending length of the skirt is somewhat longer than the corresponding depending length of the hook, and defines a cavity for receiving the spacer strip and wedge strips.

In assembling the inner and outer channel sections 1 and 2 together, the elastic wedges 5 are placed into each of the respective cavities formed between the skirts 12 and 13, so that the top face of the keystone shaped body 16 abuts against the flat inner face of the respective channel member, the shoulders filling a portion of the hooks formed therein. Thereafter, one side of the spacer strip 4 is pressed into one of the sections 1 and 2, so that its hook-like flanges 10 engage within the corresponding hook members formed on the skirts 12 (and/or 13) of the particular section member, thereby completely filling the hook, and compressing the outer shoulder portions 5, so that a tight, resiliently locking connection is made. Similarly, the body 16 of the wedge member 5 is pressed between the cross-bar 14 and the respective flat surface of the section member, thereby distending the body in the transverse direction to lock the hook members 10, laterally within the associated channel member. Subsequently, the other channel-shaped section member, with its associated wedge-like insert, is forced over the opposite side of the space 4, so that in like manner, the corresponding hook-like flanges and skirt portions engage securely and the wedge 5 is again compressed and distended to securely join that member therewith, as shown in FIG. 1.

FIG. 2 shows the essential force vectors placed upon the wedge-shaped inserts 5, which provide the secure clamping of the members together. The flat shoulder portions 15 of each insert 5 are compressed between the laterally projecting hooks 10 of the spacer strip 4, and the respective channel sections in the direction of the force f. The plug-shaped body portion 16 of each of the inserts 5 is compressed in the direction of the double arrow F, so that counter force on the section members 1 and 2 occurs, combined with the lateral distention effecting the clamping and seating, in secure arrangment, of the hook-like members therebetween.

The entire wedge-shaped insert 5 is compressed in the direction normal to the plane of the window according to arrow A, so that, in total, there results a volumetric contraction of the wedge-shaped insert 5, which is favorable to the extended maintenance of the initial tension on the insert 5, so that its position between the sectional parts 1 and 2 is secure, even after considerable use.

As can be seen from the foregoing, the flat shoulder portions of the wedge-shaped insert cause opposed clamping forces between the plastic spacer strip 4 and the inner and outer sections 1 and 2, respectively, in a direction normal to the plane of the window. The keystone-shaped body and the flat shoulders 15 form a mushroom-shaped elastic member, which provides that the hook-like members formed at the edges of the lateral walls of the H-shaped spacer strip engage within the grooves or enlargements formed by the inwardly directed hooks formed on the respective inner and outer section members. Thus, clamping action occurs perpendicular to the plane of the window, as well as parallel to the plane of the window, so that a secure, firm and exact seating of the plastic strip and of the inner and outer section members, relative to each other, is provided.

By the design of the wedge-shaped insert, a sound bridge, by which transmission of sound between the inner and outer section members, is avoided. These inserts, consisting of relatively soft rubber material, are sound-absorbing in themselves, and due to the fact that they largely fill the cavity of the H-shaped spacer strip, sound reflected surfaces are avoided. The spacer strip 4 itself becomes a heat-insulating member because of the largely hollow interior, which forms an air trap which is an effective insulator.

Figure 3:
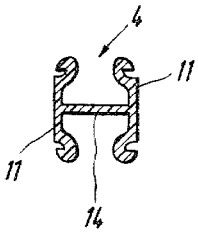
FIG. 3 is a transverse sectional view through the spacer strip employed in the assembly of FIG. 1.

A particular advantage in forming the spacer strip 4 in H-shaped cross section lies in the fact that the hook-like edges are somewhat resilient, and therefore can be easily snapped over the corresponding hooks formed in the section members 1 and 2, since they are somewhat freely movable towards each other. To facilitate the snapping action, the hook-like members can be recessed inwardly from the walls 11, by an amount at least equal to the width of the side wall, in a manner shown in FIG. 3. The lateral walls 11 can thus be made relatively thin, and overall, just as thin as the crossbar 14, and undesired profile enlargements or thickenings beyond the width of the channel member can be avoided.

While the present invention is shown as a casement frame for a window, the invention is applicable to other frame members, such as a frame for anchoring glass or other panels in masonry, or doors, or wall portions. Various other changes and modifications have been suggested. Other embodiments will be apparent to those skilled in this art.

Accordingly, the foregoing disclosure is intended to be illustrative only.

What is claimed is:

1. A frame assembly comprising a pair of open channel members, each having a central portion and substantially normally extending flanges along the longitudinal edges thereof, a spacer interposed between said channel members, said spacer being H-shaped in cross-section having a pair of lateral side walls and a central cross-bar, the ends of the lateral walls of said spacer and the flanges of said channel members being formed with cooperative engagement means, a removable plug inserted within each of the cavities formed by the lateral walls of said spacer, and the respective channel members, said plug comprising a body having a wedge shape cross-section, the larger base of said plug having a surface conforming to the central portion of said channel member and being provided with laterally extending shoulders, said surface being arranged so that it abuts the central portion of its associated channel member, and the laterally extending shoulders are compressively interposed between the flat central portion and the ends of the lateral walls of said spacer the body of said plug having a lateral dimension so as to place said cooperative engagement means under stress to lock the same.

2. The assembly according to claim 1, wherein said channel members, said spacer and said inserts are elongate.

3. The assembly according to claim 1, wherein said plugs have a dimension perpendicular to the lateral so that each is compressed between the cross-bar and the channel members to have a force vector extending parallel to the lateral walls of said spacer.

4. The assembly according to claim 1, wherein said plugs are formed of solid resilient material.

5. The assembly according to claim 4, wherein said spacer is formed of rigid material.

6. The assembly according to claim 1, wherein said cooperative engagement means comprises cooperating hooks, bent from said flanges and lateral walls opposite to each other.

7. The assembly according to claim 6, wherein the ends of said lateral walls are recessed laterally inward from the outer surface thereof by an amount at least equal to the width of said lateral wall.

8. Apparatus for joining assembly having a pair of open channel members, each having a central portion and substantially normally extending flanges along the longitudinal edges thereof, having engaging means, comprising a spacer adapted to be interposed between said channel members, said spacer being H-shaped in cross-section having a pair of lateral side walls, and a central cross-bar, the ends of the lateral walls of said spacer being formed with means for cooperatively engaging said flanges, a separate plug inserted within each of the cavities formed by the lateral walls of said spacer comprising an elongated body having a wedge-shaped cross-section, the large base of which has laterally extending shoulders adapted to be compressively interposed between the channel and the ends of the lateral walls of said spacer, said body having a lateral dimension so as to place said cooperative engagement means under stress to lock the same, when inserted fully in said cavity.

9. The apparatus according to claim 8, wherein said plugs having a dimension perpendicular to the lateral so that each is compressed between the cross-bar of the spacer and the channel member to have a force vector extending perpendicular to the cross-bar of said spacer.

10. The assembly, according to claim 8, wherein said plugs are formed of solid resilient material.

11. The assembly, according to claim 8, wherein said spacer is formed of rigid material.

12. The assembly, according to claim 8, wherein the ends of said lateral walls are recessed laterally inward from the outer surface thereof by an amount at least equal to the width of said lateral wall.

* * * * *